US006522602B2

(12) United States Patent
Nussbaum

(10) Patent No.: US 6,522,602 B2
(45) Date of Patent: Feb. 18, 2003

(54) WRISTWATCH WITH A REVERSIBLE CASE

(75) Inventor: Augustin Nussbaum, Gals (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/949,628

(22) Filed: Sep. 12, 2001

(65) Prior Publication Data

US 2002/0031052 A1 Mar. 14, 2002

(30) Foreign Application Priority Data

Sep. 14, 2000 (CH) ..... 1782/00

(51) Int. Cl.[7] ..... G04B 37/00; G04C 23/02; A44C 5/00

(52) U.S. Cl. ..... 368/88; 368/281

(58) Field of Search ..... 368/88, 276, 281, 368/282, 223, 228, 294, 295, 296, 300, 309; D10/33

(56) References Cited

U.S. PATENT DOCUMENTS 4,236,239 A * 11/1980 Imgruth et al. ..... 368/72

4,444,513 A * 4/1984 Proellochs et al. ..... 368/223

FOREIGN PATENT DOCUMENTS

| | | |
|---|---|---|
| FR | 41 060 | 11/1932 |
| WO | 86 06 511 | 11/1986 |

* cited by examiner

*Primary Examiner*—Vit Miska
(74) *Attorney, Agent, or Firm*—Sughrue Mion, PLLC

(57) ABSTRACT

A wristwatch (1) whose wristband (6) is attached to a support (3) with respect to which the case (2) can be reversed in the longitudinal direction to show one or other of its faces (16, 17). The case has a pointed profile at its ends, its faces (16, 17) having convex profiles, which are preferably similar. The bottom (4) of the support (3) is concave so as to have a substantially complementary profile to those of the faces of the case. Further, the lateral flanges (7) of the support have substantially the same convex profile, so that the case and the support are substantially flush with each other over the entire length of the case, thus giving a fluid attractive appearance to the watch and to the reversing movement of the case.

20 Claims, 6 Drawing Sheets

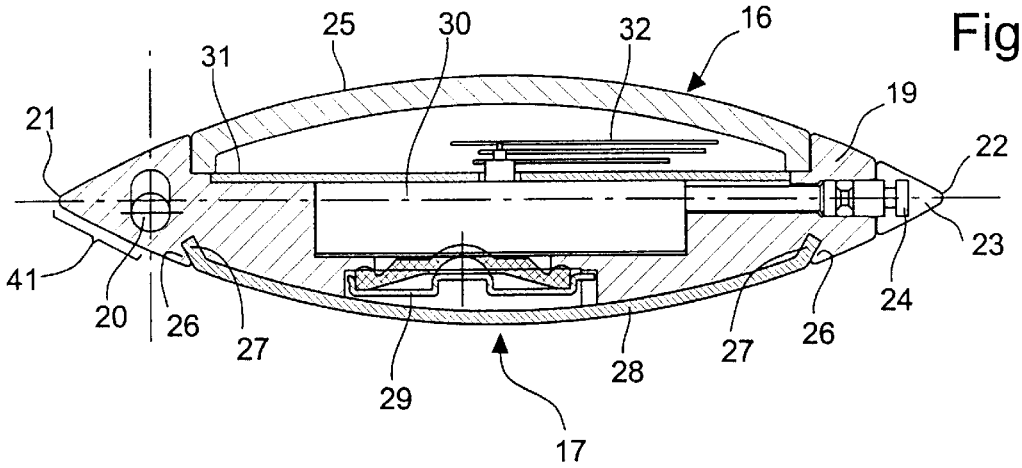
Fig. 7
Fig. 8
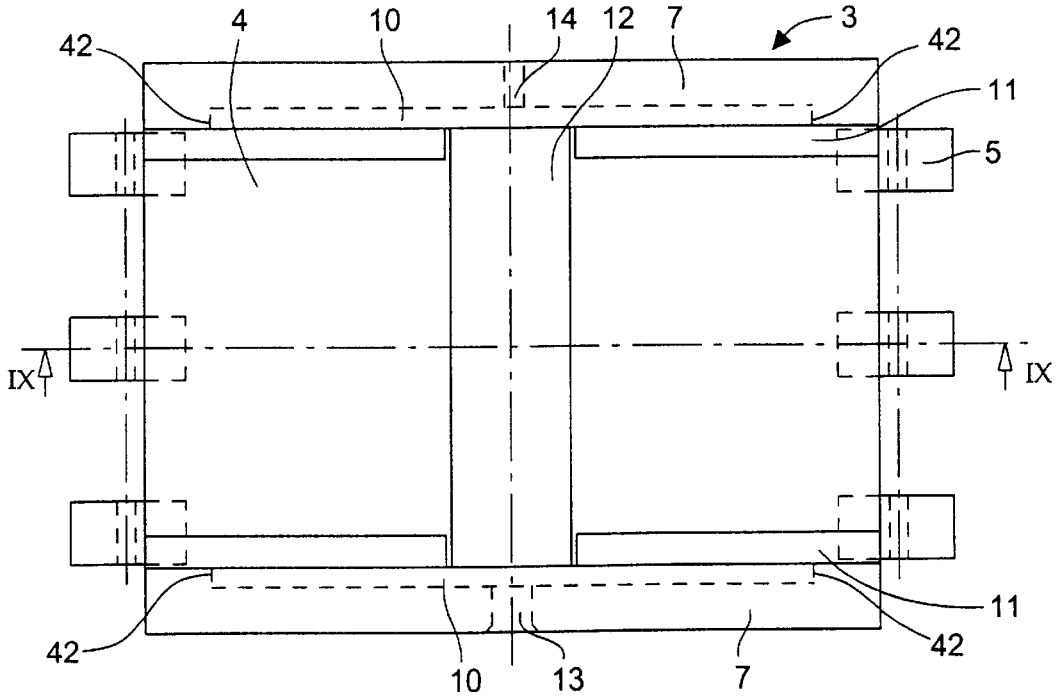

WRISTWATCH WITH A REVERSIBLE CASE

The present invention concerns a wristwatch including a support attached to a wristband and a case containing a clockwork movement and display means, the case being mounted on the support so as to be able to slide and be reversed to show respectively one or other of its faces in two operating positions, the support comprising two lateral flanges, the watch including guide means disposed on the one hand on the inner surfaces of said lateral flanges and, on the other hand on the lateral walls of the case to allow said case to slide and pivot in the support, the watch further including means for holding the case in its two operating positions.

A wristwatch of this type has been known for a long time. Additional Certificate No. 41 060 to French Patent No. 712 868 granted on Aug. 3, 1931 shows different variants wherein the case always slides in a perpendicular direction to the longitudinal direction of the wristband, i.e. in the three o'clock–nine o'clock direction of an analogue watch dial. In a first variant, the watch case is free to pivot, to turn over on itself, at any place on the support. In another variant, this pivoting freedom is restricted. Indeed, the arrangement of the mechanism is such that the case can only pivot and be reversed at the ends of the support, recesses being provided for this purpose. The type of watch disclosed includes a case of simple parallelpiped shape, the appearance of which is not particularly elegant. Moreover, this particular shape, such that the four sides of the case have a relatively large height, has the drawback of exposing the watch to external stress, such as for example shocks or friction, because of the existence of projecting parts. This is why this type of watch is made of metal, to avoid it being subjected to damage. However, because the case projects, a shock on the latter can easily cause it to move with respect to the support from its operating position, obliging the person wearing the watch to put it back in place.

The object of the present invention is to improve watches of this type, both from the ergonomic and aesthetic point of view, and to allow new varieties of reversible watches to be created, particularly made of plastic material.

The invention therefore provides a wristwatch of the type indicated hereinbefore, characterised in that the direction in which the case slides is substantially parallel to the longitudinal direction of the wristband, and in that, in longitudinal cross-section, each end of the case has a pointed profile so that, in the operating positions, the case and the support are substantially flush with each other in the zone of said ends.

In a particular embodiment, the case has a convex profile on at least one of its faces. Preferably, the two faces of the case have a substantially identical convex profile. The upper edges of the lateral flanges of the support may also have a convex profile similar to that of the case, so that the case and the support are substantially flush with each other over the entire length of the case. The means for securing the wristband, such as horns, may also have an upper part substantially flush with the support, so that the whole watch has a substantially continuous curved profile in its longitudinal direction. The bottom of the support can have a concave profile to match the profile of the case.

In a preferred embodiment, the guide means include longitudinal grooves disposed on the lateral flanges of the support and snugs located on the lateral edges of the case, each able to slide and pivot in the corresponding groove of the support. In this case, both for practical and aesthetic reasons, each of the grooves may be made to include at least one stop, disposed at a distance from its ends, the effect of said stop being to stop the case sliding after a first sliding travel of the snug from one end of the groove, to define a pivoting zone of the case, before the snug effects a second sliding travel to the other end of the groove.

The pivoting of the case will then occur exclusively in the central zone of the support, giving thus a symmetry to the movement and eliminating any risk of inadvertent pivoting caused by a possible abrupt movement of the wrist which could raise the case from its operating position.

The invention will be better understood from the following description of an embodiment example with reference to the annexed drawings, in which:

FIG. 7 is a cross-section of the watch case of FIG. 1, along its vertical median symmetrical plane;

FIG. 8 is a top view of the support of the watch of FIG. 1;

Figure 1:
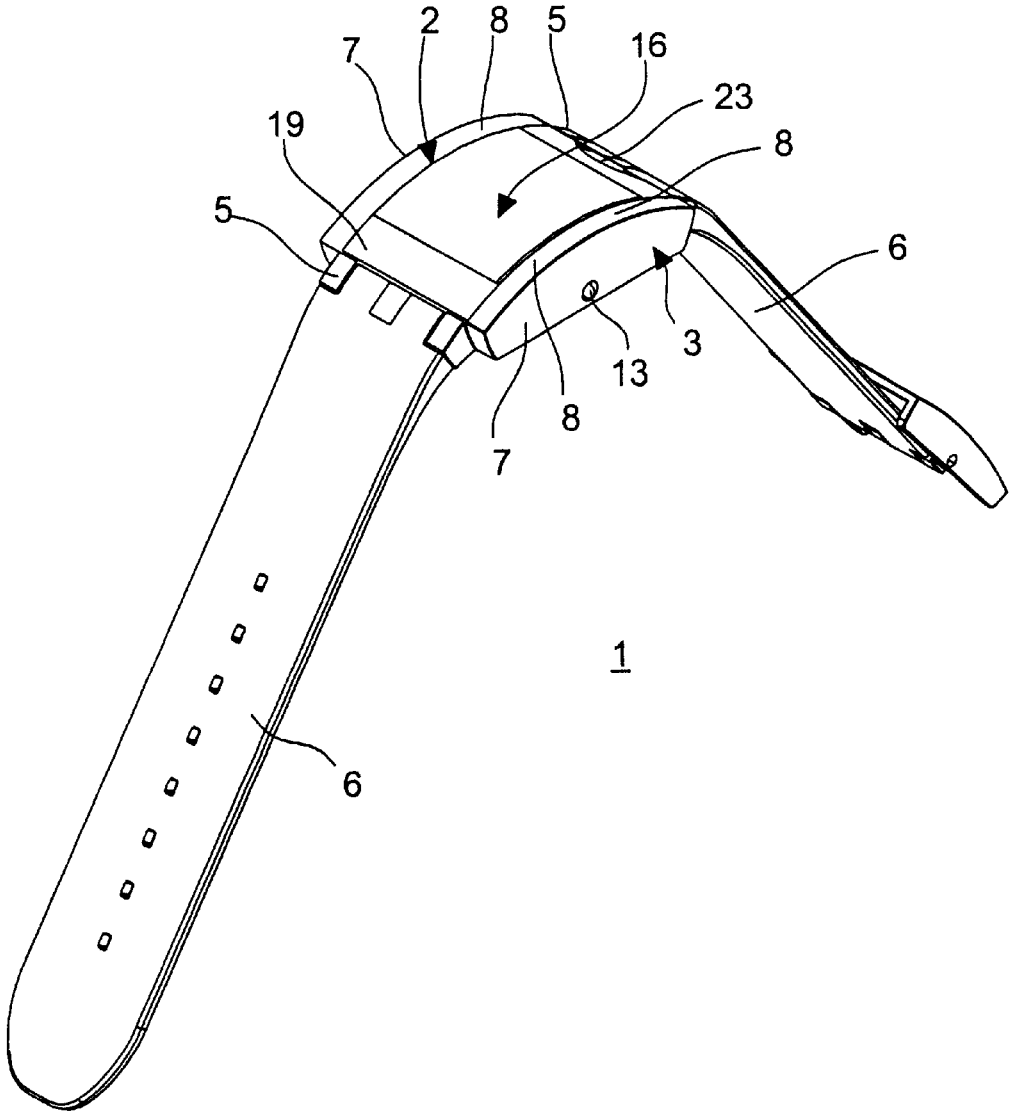
FIG. 1 is a perspective view of a preferred embodiment of a wristwatch according to the invention, in one of the two operating positions of the case.

FIGS. 1 to 6 illustrate the general appearance of wristwatch 1, according to the preferred embodiment, and the movement effected by case 2 when it slides and turns over with respect to support 3.

Support 3 includes a bottom 4 the upper part of which is concave and from which project horns 5, to which wristband 6 is secured, and lateral flanges 7 parallel to the direction of wristband 6. Each of these lateral flanges 7 has an upper edge 8 of rounded shape, a maximum height at its middle and an inner surface 9 including a longitudinal groove 10.

Bottom 4 of support 3 includes longitudinal guide surfaces 11, which are also visible in FIG. 8, extending from the ends of the support to its central region, in which there is a rounded transverse recess 12 delimited on either side by flanges 7. The latter further include holes 13 and 14 which pass through them substantially midway from the longitudinal ends of the support, opening into the corresponding groove 10.

In this embodiment, the case has a general spindle shape in its longitudinal direction which corresponds to the direction of the wristband, its lateral walls 15 being substantially plane and parallel, thus delimiting two convex faces 16 and 17 of substantially complementary shape to that of bottom 4 of the support. In particular, the longitudinal ends 21 and 22 of the case have a pointed profile so that in the operating positions, the case and the support are substantially flush with each other in this region. In a preferred variant, faces 16, 17 of the case and bottom 4 of the support each have a profile in the arc of a circle.

Each of lateral walls 15 includes a small projecting element 18 located on middle part 19 of the case and preferably having substantially the shape of a portion of a sphere. Projecting element 18 could be made to be retractable into the case by using resilient means which are not shown. A hole 20 passes through middle part 19 in proximity to an end 21 of the spindle. At its other end 22 it includes a recess 23 in the portion thereof accommodating the time-setting crown 24, said crown having a flattened shape to avoid projecting from the upper and lower faces of the case.

As is seen more clearly in FIG. 7, the case carries a curved crystal 25 on its upper face 16 and includes two fine transverse grooves 26 in its lower face 17, these grooves accommodating by lateral sliding the bent ends 27 of a decorative plate 28 of the same curvature as the crystal. This plate 28 conceals a sealed battery hatch 29 and covers, in the example shown here, most of lower face 17 for the purpose of giving the back of the case a particular aesthetic appearance. Of course, plate 28 may have other functions rather than being simply decorative, like for example covering a compartment able to receive any object or a spare battery. The case further includes, in a conventional manner, a clockwork movement 30, a dial 31 and hands 32.

It can be seen in FIG. 8 that hole 13 of one of flanges 7 has a greater cross-section than that of hole 14 of the other flange. Indeed, these two holes 13 and 14 used during the assembly and dismantling of wristwatch 1 have different functions. During assembly, case 2 has to be placed between flanges 7 of support 3, hole 20 of the case having to be aligned with holes 13 and 14 of support 3. It is then that hole 13, with the larger cross-section, receives the bar 33 shown in FIG. 11, which is inserted into the case until it abuts against opposite inner surface 9 in proximity to hole 14. The function of hole 14 is to accommodate a small tool allowing bar 33 to be forced back in the opposite direction during dismantling, so as to remove it to detach case 2 from support 3.

Figure 9:
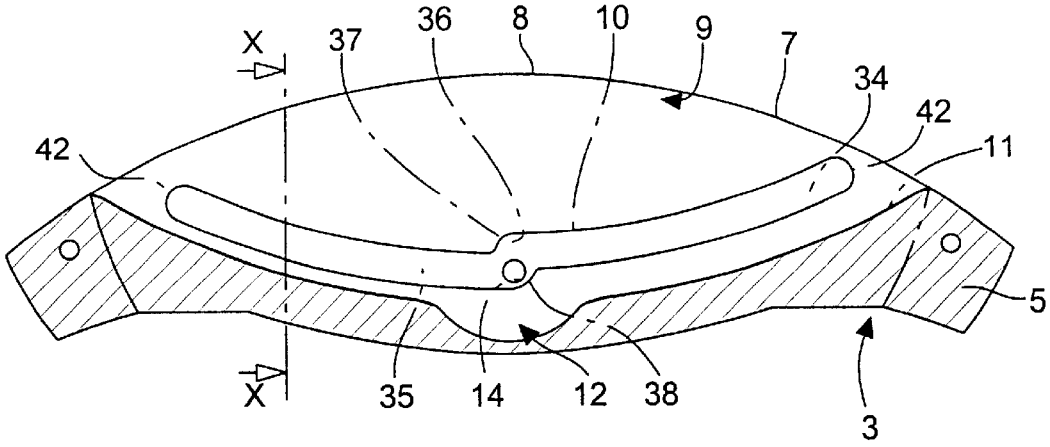
FIG. 9 is a longitudinal cross-section of the support along the line IX—IX of FIG. 8.
Figure 10:
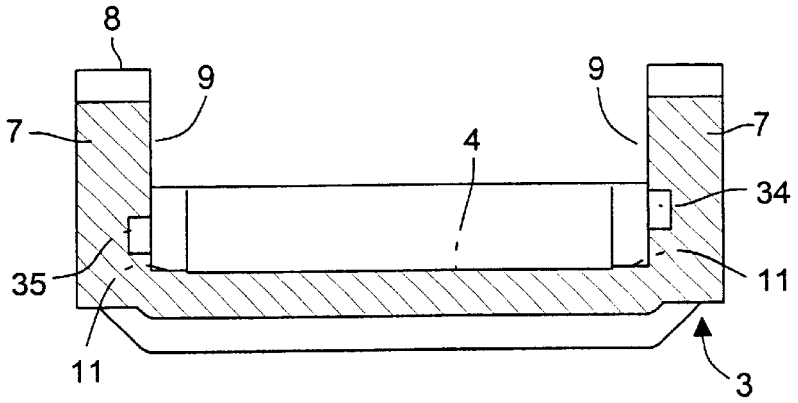
FIG. 10 is a transverse vertical cross-section of the support along the line X—X of FIG. 9.
Figure 11:
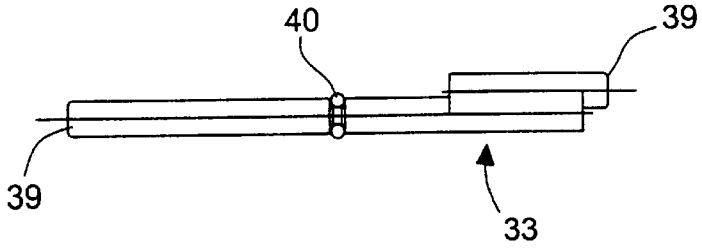
FIG. 11 is a view of the bar establishing the connection between the case and the support shown in FIGS. 8 to 10.

FIG. 9 shows the particular geometry of grooves 10 in this embodiment. These grooves are each formed of two successive sections 34 and 35, substantially parallel to guide surfaces 11 and located at different distances from the latter, thus defining a high section 34 and a low section 35, connected to each other by a vertical break 36 forming an upper stop 37 and a lower stop 38. Grooves 10 are reversed with respect to each other, so that high section 34 of one is located opposite low section 35 of the other and vice versa, as appears in FIG. 10. These grooves 10 receive snugs 39 formed by the ends of bar 33, these snugs being offset with respect to each other in height as is seen in FIG. 11. It should be noted that once bar 33 is housed in case 2, a system equivalent to the use of snugs secured to the case is obtained, the bar being held in hole 20 by friction, for example as a result of an O-ring joint 40.

Figure 4:
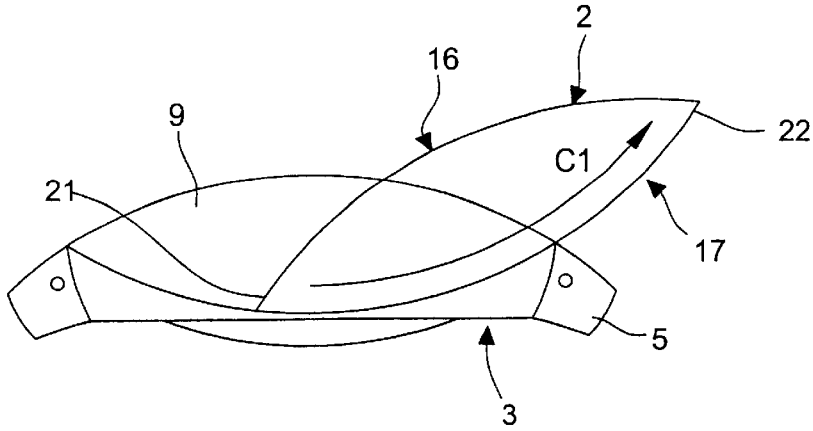
FIG. 4 is a schematic lateral view of the watch in an intermediate sliding position of the case.
Figure 5:
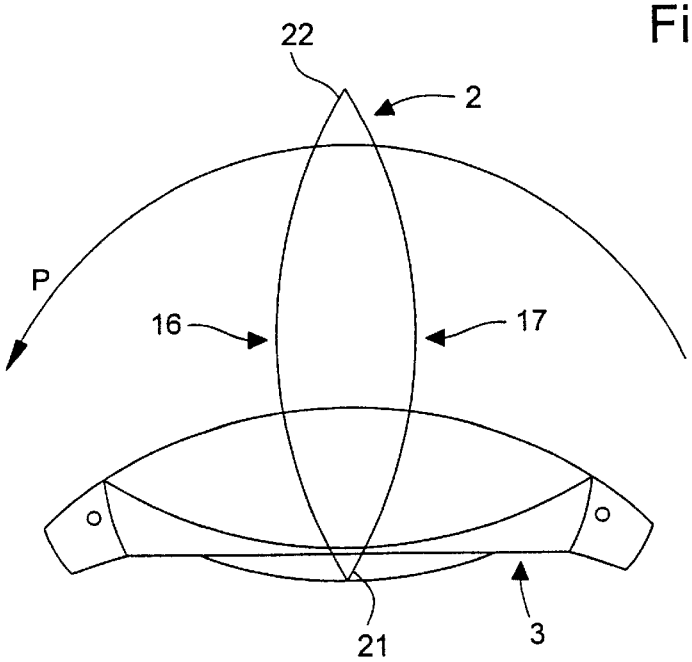
FIG. 5 is a schematic lateral view of the watch during the pivoting phase of the case.
Figure 6:
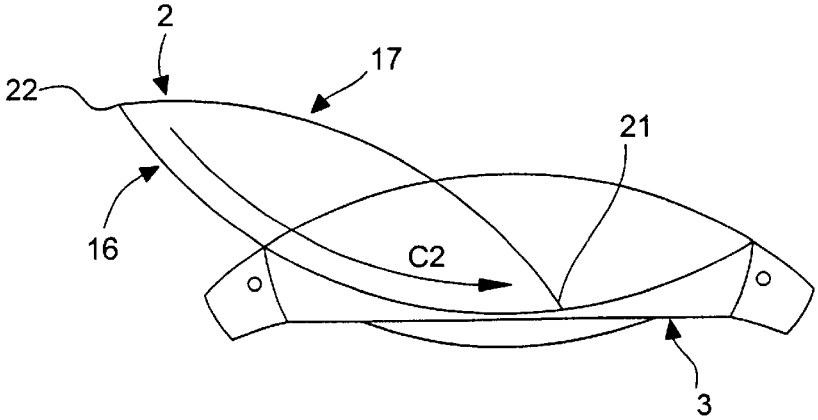
FIG. 6 is a schematic lateral view of the watch, pivoting being completed, or to the second sliding step of the case.

The reversing of case 2 in support 3 is schematised in FIGS. 4 to 6. When case 2 is mounted in support 3 and is in one of its operating positions, showing for example its upper face 16, as shown in FIG. 1, its small projecting elements 18 are snapped into grooves 10 of support 3 so as to lock it in said position. The user has to exert pressure on case 2 in a substantially parallel direction to wristband 6 in order to release it and be able to slide it as indicated by arrow C1 to bring it into the position of FIG. 4. It will be noted that when case 2 is close to an operating position, it cannot pivot around snugs 39, not only because they are not on the same axis and grooves 10 are also offset in height, but above all because the distance of snugs 39 with respect to support 3 is smaller than that with respect to end 21 of the case. Consequently, case 2 has only a very small clearance in such a position until a support zone 41 of the case, in proximity to the end provided with snugs 39, comes into contact with guide surfaces 11 of the support. Thus, during the sliding step, the user pushes case 2 by exerting pressure close to end 21, in the direction of wristband 6 shown by arrow C1 in FIG. 4. Support zones 41 slide over guide surfaces 11, until the uppermost snug 39 abuts against upper stop 37 and the lowest snug 39 abuts against lower stop 38. It should be noted that the case may preferably be made to include, on face 16, opposite guide surface 11 longitudinal edges (not shown) on either side of crystal 25, the latter being slightly set back with respect to these flanges and support zones 41, so that it does not come into contact with any element of support 3 during the movement. Case 2 then cannot continue sliding in the same direction. Since end 21 of the case is located above recess 12, pivoting is made possible. Indeed, the user causes end 23 of the case to be raised then completely pivoted, as schematised by arrow P in FIGS. 5 and 6, so that the uppermost snug 39 moves downwards and is located at the level of low section 35 of the corresponding groove, while the lowest snug 39 moves upwards and is located at the level of high section 34 of the corresponding groove. When the case is in the position of FIG. 6, it can effect a second sliding travel in the same direction, as indicated by arrow C2 of FIG. 6, via the action of pressure by the user close to its end 22. The second operating position, in which lower decorative face 17 of the case is visible, is achieved when snugs 39 reach a stop against ends 42 of grooves 10 and the small projecting elements 18 are fitted into the other ends of grooves 10, thus locking case 2.

In order to return to the first operating position in which upper face 16 is visible, the same series of operations need only be effected in the opposite direction, since snugs 39 have changed side with respect to support 3 of the watch.

One advantage of such a structure is that it prevents case 2 being able to be slid from one end 42 of grooves 10 to the other, without pivoting at stops 37 and 38. Moreover, given the great height of flanges 7 of the support in the vicinity of recess 12, there is no possibility of case 2 reaching a position without lateral support.

Figure 12:
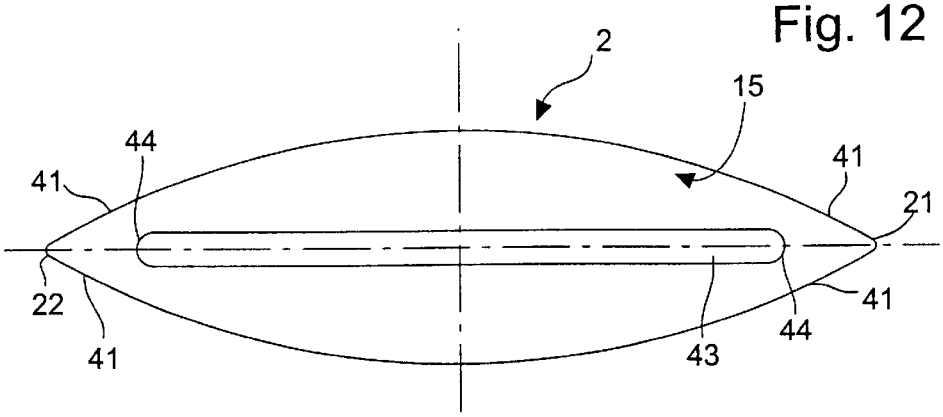
FIG. 12 is a schematic lateral view of the case in a second embodiment, in which the grooves are located on the case and the snugs on the support.
Figure 13:
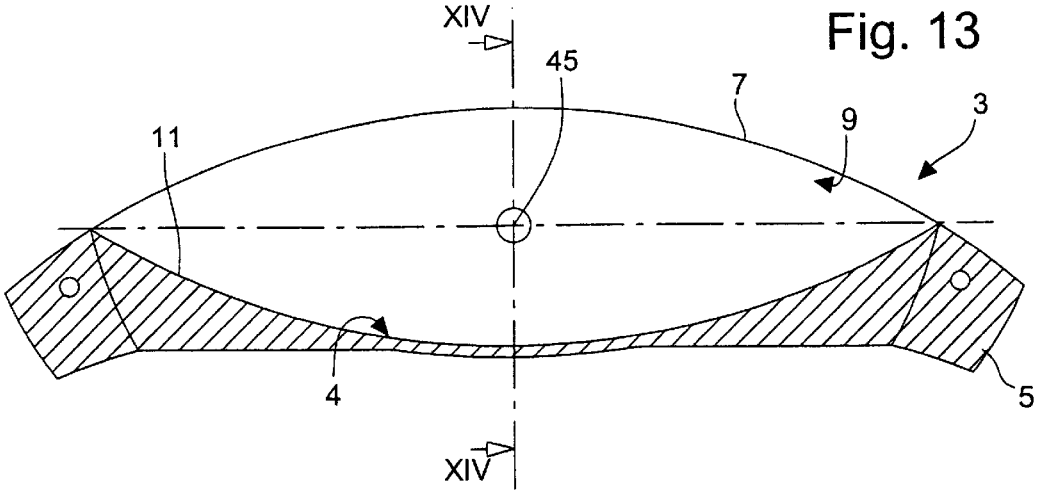
FIG. 13 is a similar cross-section to that of FIG. 9, for the same embodiment as FIG. 12.
Figure 14:
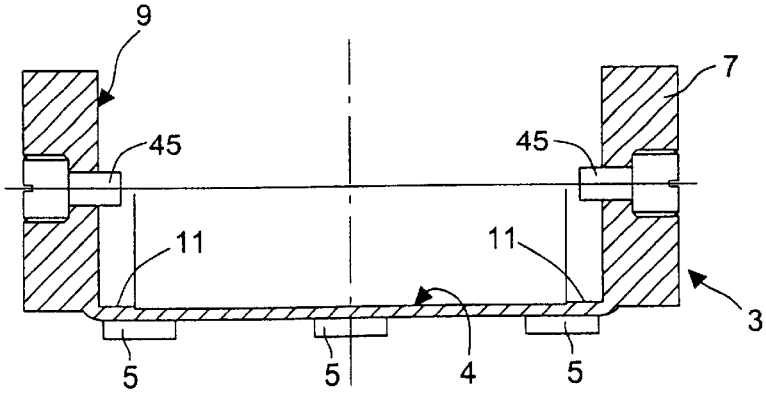
FIG. 14 is a transverse vertical cross-section of the support along the line XIV—XIV of FIG. 13.

FIGS. 12 to 14 illustrate a second embodiment of the reversible watch according to the invention, wherein the general respective shapes of the case and the support are the same as in the embodiment shown in FIGS. 1 to 11, while the arrangement of the case guide means is reversed. In this variant, each of lateral walls 15 of the case includes, substantially at mid-height, a longitudinal groove 43 closed at its ends 44. The inner surfaces 9 of support 3 each include, at the centre of the part accommodating the case, a snug 45 of cylindrical shape able to slide and pivot in the corresponding groove 43. These snugs may for example be obtained by inserting screws through lateral flanges 7 of support 3, as shown in FIG. 14. It is to be noted in FIG. 13 that guide surfaces 11, as described in the embodiment shown in FIGS. 1 to 11, are also present in this embodiment.

Figure 2:
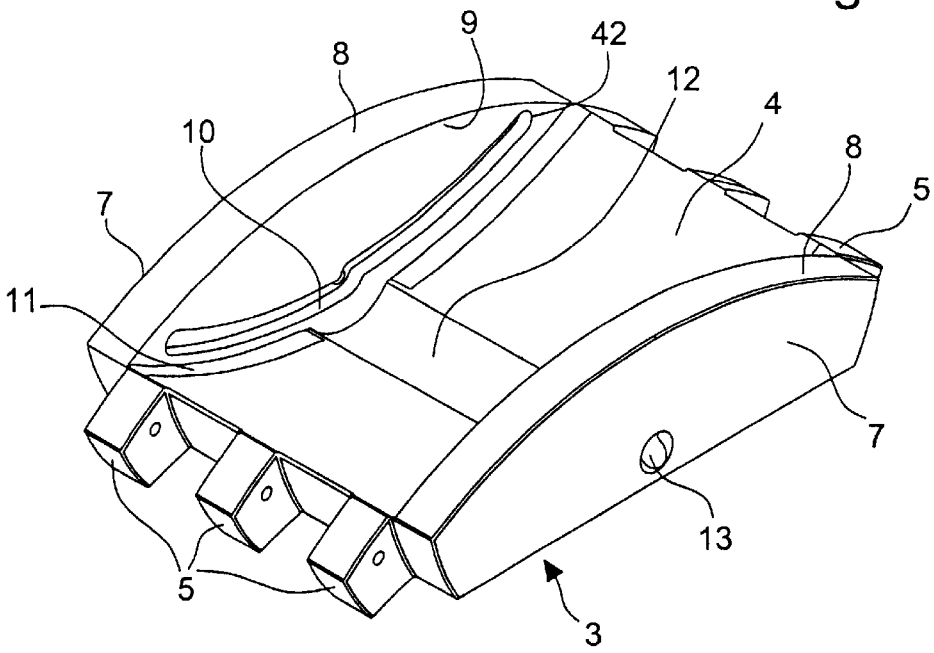
FIG. 2 is a perspective view of the support of the watch of FIG. 1.
Figure 3:
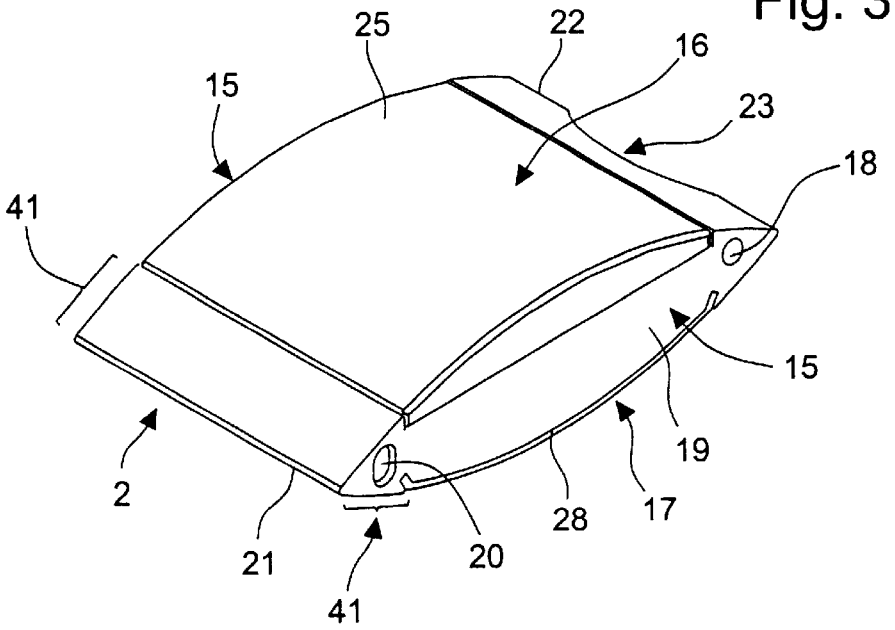
FIG. 3 is a perspective view of the case of the watch of FIG. 1.

The operation of this system is substantially the same as that previously described. Starting from a first operating position, case 2 is released by pressure by the user on one of support zones 41 in the longitudinal direction of the wristband one way or another. The case then effects a first sliding travel until each of snugs 45 abuts against the end 44 of the corresponding groove 43. The user has then to pivot the case around said snugs to turn it over. It should however be noted that recess 12 in the bottom of the support as shown in FIGS. 2, 8 and 9 is not reproduced in this variant. Indeed, the distance between a snug 45 and bottom 4 of the support is substantially greater than the distance between an end 44 of a groove and the corresponding end 21 or 22 of the case, thus allowing the case to pivot freely as soon as snugs 45 are at one end of the groove. This advantageously adds the possibility of constructing a support 3 whose bottom 4 has a reduced thickness. Once the case has been turned over, it can effect a second sliding travel to its second operating position where it is locked by snapping means which are not shown. In order to return to the first operating position, the user has to repeat the above steps starting by exerting pressure on one of support zones 41 of the case in the longitudinal direction of the wristband. Because of the symmetry of the case-support assembly and the guide means used, the user can exert pressure either in the opposite direction with respect to that of the first reversal or in the same direction, which was not possible for the watch shown in FIGS. 1 to 11.

From this embodiment, multiple variants may be envisaged, consisting for example in placing snugs 45 lower on the support and making curved grooves 43, making grooves 43 with a smaller length so that they stop in the middle of the case, or modifying the height of grooves 43 as a function of the desired kinematics for the reversing movement of the case.

The respective shapes of case 2 and support 3 provide wristwatch 1 with aesthetic advantages due to the continuity of the shapes, the symmetry and fluidity of the complete movement of case 2. It should be noted that such a line means that the reversible nature of the watch according to the invention is not immediately visible when it is in one of its operating positions. The fact that the reversing movement of the case preferably occurs in the direction of wristband 6, i.e. in the six o'clock-twelve o'clock direction of an analogue watch dial, allows an attractive and original construction, but it may also be made to occur laterally. It should also be noted that guide surfaces 11 of support 3 have an additional function, which is preventing crystal 25 from coming into contact with support 3 and thus being damaged. The particular and complementary shapes of the case and the support give the watch another advantage which is good resistance to shocks and wear by friction, since, as appears in FIGS. 1 to 3, the watch does not have any projecting parts. This means that an embodiment in inexpensive moulded plastic as well as metal can be used.

Multiple applications may be imagined for the wristwatch with the reversible case according to the invention, whether it is made of moulded plastic material or metal. Indeed, the use of a decorative plate covering one of the faces of the case and able to conceal a compartment was described, but the case may also be made to include, in place of the plate, a second analogue or digital display used to display, for example, the time of day, a second time zone, possibly using a second movement, measured times, or any other type of information.

What is claimed is:

1. A wristwatch including a support comprising securing means to a wristband and a case comprising two ends, two faces, a crystal and lateral walls extending in the longitudinal direction of said wristband and between which are contained a clockwork movement and display means, the case being mounted on the support so as to be able to slide and be reversed to show respectively one or other of its faces in two operating positions, the watch further including means for holding the case in its two operating positions, the support comprising two ends and two lateral flanges each having an inner surface, the watch including guide means disposed on the one hand on said inner surfaces of said lateral flanges, and on the other hand on said lateral walls of the case to allow said case to slide and pivot in the support, wherein the direction in which the case slides is substantially parallel to the longitudinal direction of the wristband and wherein each end of the case has in longitudinal cross-section a pointed profile, so that in said operating positions, said case ends and said support are substantially flush with each other.

2. A wristwatch according to claim 1, wherein the case includes, in said longitudinal direction, a convex profile on at least one of its faces.

3. A wristwatch according to claim 2, wherein the case has said convex profile on its two faces.

4. A wristwatch according to claim 3, wherein, in said longitudinal direction, said lateral flanges have upper edges each presenting a similar convex profile to that of the case, so that the case and the support are substantially flush with each other over the entire length of the case in said operating positions of the case.

5. A wristwatch according to claim 4, wherein said securing means have an upper part which is substantially flush with said support ends, so that the whole wristwatch has a substantially continuous curved profile in said longitudinal direction.

6. A wristwatch according to claim 2, wherein the support includes a bottom presenting an upper surface in between said lateral flanges, said upper surface having a concave profile in said longitudinal direction, so as to substantially match the profile of the case.

7. A wristwatch according to claim 3, wherein the support includes a bottom presenting an upper surface in between said lateral flanges, said upper surface having a concave profile in said longitudinal direction, so as to substantially match the profile of the case.

8. A wristwatch according to claim 5, wherein the support includes a bottom presenting an upper surface in between said lateral flanges, said upper surface having a concave profile in said longitudinal direction, so as to substantially match the profile of the case.

9. A wristwatch according to claim 2, wherein said guide means include two longitudinal grooves having closed ends and each located on one of the inner surfaces of said lateral flanges, and snugs projecting over the lateral walls of the case facing said inner surfaces, each able to slide and pivot in the corresponding groove of the support, each of said grooves including at least one stop disposed at a distance from its ends, said stop having the effect of stopping the case after a first sliding travel of the corresponding snug from one end of the groove, to define a pivoting zone for the case, before said snug effects a second sliding travel to the other end of the groove.

10. A wristwatch according to claim 3, wherein said guide means include two longitudinal grooves having closed ends and each located on one of the inner surfaces of said lateral flanges, and snugs projecting over the lateral walls of the case facing said inner surfaces, each able to slide and pivot in the corresponding groove of the support, each of said grooves including at least one stop disposed at a distance from its ends, said stop having the effect of stopping the case after a first sliding travel of the corresponding snug from one end of the groove, to define a pivoting zone for the case, before said snug effects a second sliding travel to the other end of the groove.

11. A wristwatch according to claim 6, wherein said guide means include two longitudinal grooves having closed ends and each located on one of the inner surfaces of said lateral flanges, and snugs projecting over the lateral walls of the case facing said inner surfaces, each able to slide and pivot in the corresponding groove of the support, each of said grooves including at least one stop disposed at a distance from its ends, said stop having the effect of stopping the case after a first sliding travel of the corresponding snug from one end of the groove, to define a pivoting zone for the case, before said snug effects a second sliding travel to the other end of the groove.

12. A wristwatch according to claim 2, wherein said guide means include two longitudinal grooves having closed ends and each located on one of the lateral walls of the case, and snugs projecting over the inner surfaces of said lateral flanges facing said grooves, each able to slide and pivot in the corresponding groove of the case, each of the ends of a groove constituting a stop in the sliding travel of the corresponding snug, thus defining a pivoting zone for the case.

13. A wristwatch according to claim 3, wherein said guide means include two longitudinal grooves having closed ends and each located on one of the lateral walls of the case, and snugs projecting over the inner surfaces of said lateral flanges facing said grooves, each able to slide and pivot in the corresponding groove of the case, each of the ends of a groove constituting a stop in the sliding travel of the corresponding snug, thus defining a pivoting zone for the case.

14. A wristwatch according to claim 6, wherein said guide means include two longitudinal grooves having closed ends and each located on one of the lateral walls of the case, and snugs projecting over the inner surfaces of said lateral flanges facing said grooves, each able to slide and pivot in the corresponding groove of the case, each of the ends of a groove constituting a stop in the sliding travel of the corresponding snug, thus defining a pivoting zone for the case.

15. A wristwatch according to claim 11, further including, outside the pivoting zone, means for preventing the case from pivoting.

16. A wristwatch according to claim 14, further including, outside the pivoting zone, means for preventing the case from pivoting.

17. A wristwatch according to claim 15, wherein said means for preventing the case from pivoting are formed by at least a guide surface on the support, on which a support zone of the case can rest when sliding.

18. A wristwatch according to claim 16, wherein said means for preventing the case from pivoting are formed by at least a guide surface on the support, on which a support zone of the case can rest when sliding.

19. A wristwatch according to claim 17, wherein the case further includes longitudinal flanges on either side of said crystal, the latter being set back from said longitudinal flanges, so that it does not come into contact with any element of the support during the movement.

20. A wristwatch according to claim 18, wherein the case further includes longitudinal flanges on either side of said crystal, the latter being set back from said longitudinal flanges, so that it does not come into contact with any element of the support during the movement.

* * * * *